United States Patent [19]

Martinez

[11] 4,209,214

[45] Jun. 24, 1980

[54] MOVABLE ELECTRICAL CONTACT DEVICE

[75] Inventor: Joachim Martinez, Avallon, France

[73] Assignee: R.K.S., France

[21] Appl. No.: 964,011

[22] Filed: Nov. 27, 1978

[30] Foreign Application Priority Data

Dec. 2, 1977 [FR] France ..... 77 36373

[51] Int. Cl.[2] ..... H01R 39/00

[52] U.S. Cl. ..... 339/5 M; 339/258 R

[58] Field of Search ..... 339/5 M, 5 P, 5 S, 7, 339/8 PB, 258 R, 258 A, 258 P

[56] References Cited

U.S. PATENT DOCUMENTS 3,216,262 11/1965 Swarts et al. ..... 339/5 M X

*Primary Examiner*—Roy Lake

*Assistant Examiner*—DeWalden W. Jones

*Attorney, Agent, or Firm*—Beveridge, DeGrandi, Kline & Lunsford

[57] ABSTRACT

A plurality of conductive rings are arranged projecting relatively to a fixed component. Such ring comprises two thin conductive circles separated by an electrically insulating material. Blades fixed to pins make sliding contact with the outer and inner circles. The blades are advantageously staggered relatively to one another. It is thus possible to obtain a very compact electrical contact device between two concentric members capable of undergoing relative rotation.

5 Claims, 3 Drawing Figures

MOVABLE ELECTRICAL CONTACT DEVICE

The present invention has as its subject a contact device intended to establish an electrical connection between two concentric members capable of undergoing relative rotation.

It is known in general to establish such an electrical contact between two rotary members by means of a rubbing element in the form of a brush or blade, fixed to one of the members and in contact with an annular conductive portion forming part of the outer surface of the other member.

However in certain applications where the bulk must be reduced as far as possible, this type of contact device is difficult to use, because it requires a not insignificant increase of the dimensions of the rotary members so as to provide a sufficient contact surface. This is particularly the case when it is necesssary in such a contact device to provide a plurality of independent contacts between the two members rotating relatively to one another.

The present invention has as its object to produce a movable electrical contact device permitting an extremely compact and simple construction enabling a large number of independent electrical connections.

The movable electrical contact device of the invention is intended to provide a contact between two concentric members capable of undergoing a relative rotation. It comprises at least one contact blade fixed to one member and in rubbing contact with an annular conductive portion fixed to the other member. According to the invention the said annular portion comprises at least one conductive ring projecting relatively to the member to which it is fixed. Thanks to this particular arrangement of the said annular portion, it is possible to reduce the bulk of the device.

The projecting conductive ring preferably comprises an assembly of two thin conductive circles separated by an electrically insulating material. The contact blades are then arranged in pairs and cooperate from both sides with the conductive circles on each side of the insulating material.

In the preferred embodiment of the invention, the electrical contact device provides a plurality of distinct electrical connections and then comprises a plurality of conductive rings, the said contact blades being arranged in a staggered pattern relatively to one another. Preferably the contact blades are mounted in groups in at least one block of insulating material, such as a synthetic plastics material, the said block being inserted into a recess made in one of the said concentric members facing the said conductive rings fixed to the other member.

The blades making contact with the inner conductive circles are advantageously mounted in a first insulating block, while the blades making contact with the outer conductive circles are mounted in a second insulating block arranged close to the first in the peripheral direction. In this way, it is possible to arrange the different conductive rings close to one another with a very slight separation between them without harming the insulation of the different electrical connections. Thus a further improvement is obtained here in the compactness of the contact device according to the invention.

The invention will be better understood from study of the detailed description which will follow of one embodiment, taken by way of an example which is in no way limiting, applied to the control of a turret of a military tank. The description will be made with reference to the accompanying drawing, in which.

In the example shown in the figures, the device according to the invention is applied to the electrical connection between the turret base and the movable turret of a military tank. In this kind of application, the problems of compactness are particularly important, which justifies the significance of the invention. It will however be understood that the invention could be applied in other fields, and at all times where it is necessary to provide an electrical connection between two members movable one relatively to the other.

Figure 1:
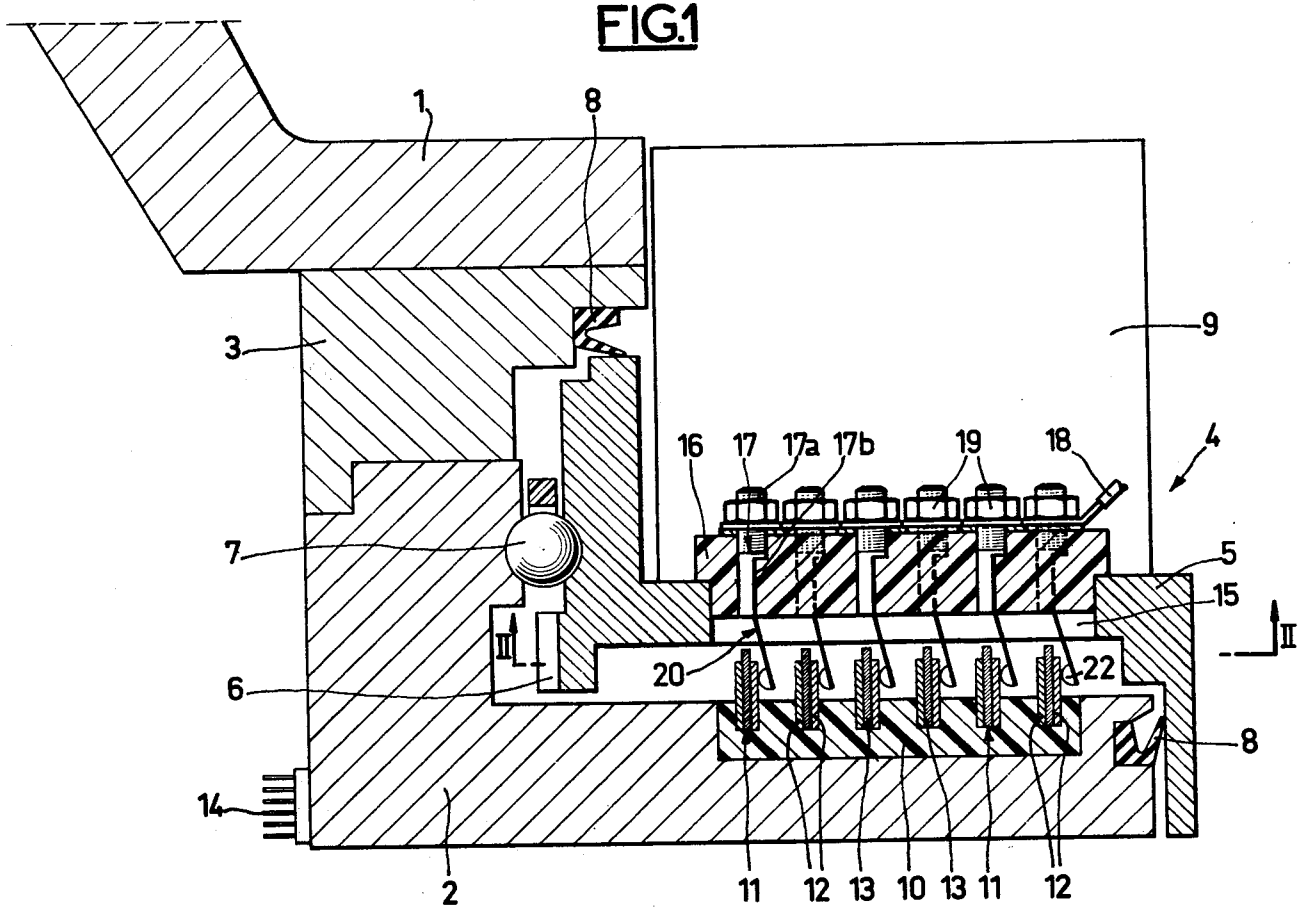
FIG. 1 is a fragmentary view in diagrammatic section of a device according to the invention.

It will be seen in FIG. 1 that the turret base 1 is fixed to an annular plate 2 by means of an intermediate member 3 by bolts, which are not shown. The turret itself 4 can undergo a rotation relative to the turret base 1, and is driven by a traversing ring 5 provided with teeth 6 cooperating with a driving pinion not shown in the figure. A ball bearing 7 facilitates the rotation of the ring 5 relative to the turret base 1. Lip sealing rings 8 ensure sealing and the protection of the driving mechanism and of the contacts. The traversing ring 5 supports an assembly of components and control mechanisms, shown as a block 9, which it is necessary to supply with electric current by means of the contact device according to the invention.

For this purpose, the annular plate 2 has in its horizontal portion an annular channel receiving a circle 10, preferably made in an electrically insulating material such as a synthetic plastic material. A plurality of conductive rings 11 are arranged concentrically and fixed in a firm manner to the circle 10. In the case in which this circle is of plastic material, it is possible to embed the rings 11 partially in the interior of the material itself of the circle 10 during a moulding operation.

As can be seen in FIG. 1, the conductive rings 11 project relatively to the annular plate 2 and present a generally cylindrical shape, the axis of which is the same as the axis of rotation of the traversing ring 5 relative to the turret base 1.

Each ring 11 comprises an assembly of two thin conductive circles 12 separated by a ring 13 made of an electrically insulating material, the assembly being conveniently fixed together so as to constitute only a single component. Each conductive circle 12 is connected electrically by connections, not shown, through the circle 10 and the annular plate 2 to the supply coupling 14.

Figure 2:
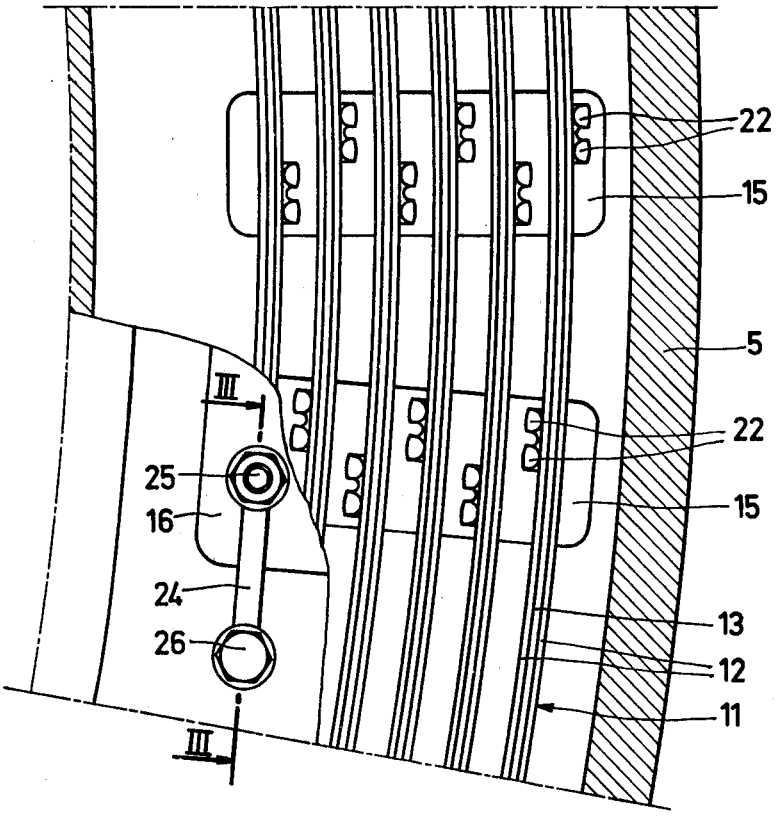
FIG. 2 is a view in partial section from below on II—II of the contact device seen in FIG. 1, certain components having been removed to assist understanding.

The traversing ring 5 has two recesses 15, visible more particularly in FIG. 2, within which are inserted two blocks 16 made of an insulating material, as for example of a synthetic plastic material. Each block 16 has a set of bores receiving milled pins 17, preferably embedded in the block 16 during moulding. Each of the pins 17 has an upper threaded end **17*a* which projects outside the block 16 and permits the attachment of electrical connections 18 by means of nuts 19. The lower part 17*b* of the pin 17, unthreaded and embedded in the interior of the block 16, has a flat surface obtained for example by milling and on which is fixed, preferably by welding, the upper part of a contact blade 20**.

In the embodiment shown in the figures, each block 16 receives six contact blades 20 and thus includes the same number of pins 17. The pins and the blades which are fixed to them are placed in a staggered pattern as can be seen in FIG. 2, so as to permit restriction to the maximum extent of the relative spacing of the different conductive rings 11.

The axes of the pins 17 pass substantially through the corresponding conductive rings 11, the blades 20 having a lower inwardly curved portion with two arms 21, provided at their extremity with contact tips 22 which come into contact with the conductive circles 12.

In the example shown, all the blades 20 which come into contact with the conductive circles 12 placed on the inside are mounted in a first insulating block, while the blades 20 which come into contact with the outer conductive circles 12 are mounted in another insulating block 16 placed alongside the previous one and slightly separated from the latter in the peripheral direction of the conductive rings 11. This arrangement is particularly visible in the view of FIG. 2.

Figure 3:
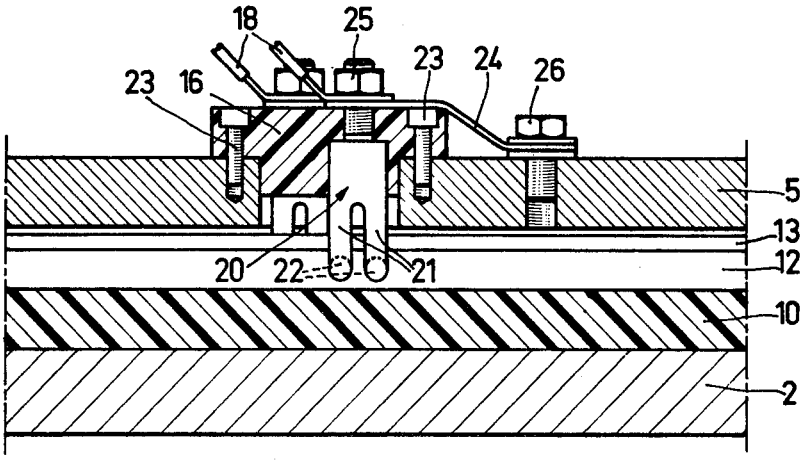
FIG. 3 is a sectional view along III—III in FIG. 2.

As can be seen in FIG. 3, the insulating blocks 16 are fixed to the traversing rings 5 by means of screws 23 with embedded heads. A conductive braid 24 connects one of the contact pins, identified as 25, to the body of the device via the screw 26 fixed to the traversing ring 5.

Thanks to the arrangement which has been described, it will be seen clearly in the figures that it is possible to obtain a contact device of very small dimensions not only by reason of the particular projecting construction of the conductive rings 11 which reduces the bulk in the radial direction, but equally thanks to the staggered arrangement of the different contact blades, which reduces the dimensions of the device in the tangential direction.

In the embodiment shown in the figures, the projecting conductive rings are arranged, as has been seen, on the annular plate 2 and thus have a generally cylindrical shape, the said rings being concentric relatively to one another. It will of course be understood that it would be possible without substantial modification to arrange the said projecting conductive rings differently, for example by giving them a generally flat annular shape, each of the rings then having the same diameter. Then the flat rings would be arranged one above the other in a vertically stacked arrangement having all the same axis. The different contact blades would no longer be disposed vertically as in FIG. 1 to 3 but substantially horizontally.

In the same manner, although the conductive rings have been shown in the embodiment as being fixed to the stationary member while the contact blades are fixed to the mobile member, it will be understood that it would be possible to invert this arrangement without substantial modification.

I claim:

1. A movable electrical contact device comprising: two concentric members capable of relative rotation;

a plurality of cylindrical conductive rings affixed to a surface of the first of said members such that each of said conductive rings projects from said surface and is in axial alignment with both of said members, said conductive rings being comprised of two thin conductive circles and an electrically insulating material separating said circles; and a plurality of pairs of contact blades affixed to a second of said members in a staggered arrangement relative to one another, the blades of each said pair contacting one and the other of the circles of a respective one of said conductive rings.

2. A movable electrical contact device according to claim 1 further comprising at least one block of insulating material inserted into a recess in the second of said members such that said insulating material faces said surface, and wherein said contact blades are mounted in groups on said at last one block.

3. A movable electrical contact device according to claim 2 further comprising milled pins embedded in the insulating material of said block, with said blades welded to said pins and having two limbs carrying contact tips, said contact tips engaging said circles.

4. A movable electrical contact device comprising: two concentric members capable of relative rotation;

a plurality of cylindrical conductive rings affixed to a surface of the first of said members such that each of said conductive rings projects from said surface and is in axial alignment with both of said members, said conductive rings being comprised of two thin conductive circles and an electrically insulating material separating said circles;

at least two insulating blocks affixed in a recess in the second of said members and facing said conductive rings; and a plurality of pairs of contact blades affixed in groups to said insulating blocks, the blades of each pair cooperating with one and the other of the circles of a respective one of said conductive rings, such that the blades making contact with the conductive circles on the insides of said conductive rings are mounted in a first one of said insulating blocks and the blades making contact with the conductive circles on the outside of said conductive rings are mounted in a second one of said insulating blocks arranged close to said first one of said blocks in the peripheral direction.

5. A movable electrical contact device according to claim 4 further comprising milled pins embedded in the insulating material of said blocks, with said blades welded to said pins and having two limbs carrying contact tips, said contact tips engaging said circles.

* * * * *